United States Patent [19]

Sugiyama

[11] 4,256,432

[45] Mar. 17, 1981

[54] CONSTRUCTION OF CIRCUIT FOR WORKING VEHICLE OPERABLE AS BACKHOE AND ALSO AS DOZER

[75] Inventor: Shiro Sugiyama, Sakai, Japan

[73] Assignee: Kubota, Ltd., Osaka, Japan

[21] Appl. No.: 935,832

[22] Filed: Aug. 22, 1978

[30] Foreign Application Priority Data

Oct. 31, 1977 [JP] Japan ..... 52-146956

[51] Int. Cl.[3] ..... E02F 3/32

[52] U.S. Cl. ..... 414/694

[58] Field of Search ..... 414/694; 37/117.5

[56] References Cited

U.S. PATENT DOCUMENTS

| | | | |
|---|---|---|---|
| 3,172,552 | 3/1965 | Metrailler | 414/694 |
| 3,922,855 | 12/1975 | Bridwell | 414/694 X |
| 4,030,623 | 6/1977 | Bridwell et al. | 414/694 |

FOREIGN PATENT DOCUMENTS

| | | | |
|---|---|---|---|
| 982089 | 1/1976 | Canada | 414/694 |
| 852925 | 11/1960 | United Kingdom | 414/694 |

*Primary Examiner*—Stephen G. Kunin

*Assistant Examiner*—Terrance L. Siemens

*Attorney, Agent, or Firm*—Edwin E. Greigg

[57] ABSTRACT

A hydraulic circuit construction for a working vehicle operable as a backhoe and also as a dozer, the circuit construction comprising a multiplex valve assembly with a dozer control valve for a dozer system, a motor control valve for one of right and left running systems, and an arm confluence valve for supplying pressure fluid to an arm cylinder of a backhoe system from a pump common to the dozer and motor valves are connected in series with one another to the pump, and a change-over valve is provided downstream from the dozer and the motor valves and upstream from the arm confluence valve for interrupting the supply of the pressure fluid from the pump to the arm confluence valve. The above circuit construction enables the vehicle to perform both operations, namely a bulldozing operation without the vehicle being urged to run obliquely, and a successful running out operation from a marshy ground by an arm operation without any one of the running system being urged to stop by the work load of the arm.

2 Claims, 2 Drawing Figures

CONSTRUCTION OF CIRCUIT FOR WORKING VEHICLE OPERABLE AS BACKHOE AND ALSO AS DOZER

BACKGROUND OF THE INVENTION

1. Field of the Invention

The present invention relates to a hydraulic circuit construction for a working vehicle equipped with a backhoe system, a dozer system and right and left running systems, in which a first hydraulic motor for one of the running systems and a hydraulic cylinder for the dozer system are adapted to be operated by a first hydraulic pump, a second hydraulic motor for the other running system and a hydraulic cylinder for an arm of the backhoe system are adapted to by operated by a second hydraulic pump, and further said arm cylinder is adapted to receive pressure fluid from the first and second pumps at the same time. The circuit construction comprises a multiplex valve assembly including a control valve for the second motor and a control valve for the arm cylinder connected in parallel with each other to the second pump, and a further multiplex valve assembly including a control valve for the dozer cylinder, a control valve for the first motor and a confluence control valve for supplying the pressure fluid from the first pump to the arm cylinder.

2. Description of the Prior Art

The above-described circuit construction has an advantage that the piping system and the valve arrangement are simple because of the employment of the multiplex valve assemblies resulting in an extremely compact overall piping system, and a further advantage that a higher operational efficiency of the arm of the backhoe system is achieved by incorporating into the hydraulic system for the first pump the confluence circuit for the arm cylinder to be primarily operated by the second pump.

On the other hand, in order to employ a multiplex valve assembly, all control valves therein have to be connected, selectively, either in parallel or in series with one another to the pump common to them. Accordingly, said three control valves in the further multiplex valve assembly, namely the dozer, first motor and arm confluence valves, have also to be connected either in parallel or in series with one another to the first pump.

In case the three valves are connected in parallel, the following problem occurs when bulldozing and running operations are conducted at the same time (the backhoe system stays idle then).

In this case, the revolution speed of the first motor becomes lower than that of the second motor as the pressure fluid from the second pump is wholly supplied to the second motor whereas the pressure fluid from the first pump is divided to the dozer cylinder and to the first motor, which results in an oblique running of the working vehicle.

On the contrary, in case that the three valves are connected in series, the above-described problem when bulldozing and running operations at the same time is solved, but another problem occurs when, for example, attempting to drive the vehicle out of a marshy ground by operating both motors and the arm of the backhoe system at the same time with the bucket engaged in the ground (the dozer system stays idle then). That is to say, in such a case the second motor can be held in operation as the second motor and the arm cylinder are connected in parallel with each other to the second pump whereas the first motor becomes inoperative by the work load on the arm, which results in a running state of the vehicle with only one running system operated. With the running systems thus operated only on one side, the vehicle would be unable to run out of the marshy ground as desired, while other objections would occur such as release of the pressure fluid, rise in the temperature of the fluid or loss of the engine power.

It will be clear from the above description that prior art working vehicles incorporating multiplex valve assemblies because of their advantages are unable to achieve one of both types of operations, namely a bulldozing operation without the vehicle being urged to run obliquely or a successful running out operation from a marshy ground by operating the arm of a backhoe system without any one of the running systems being urged to stop.

SUMMARY OF THE INVENTION

An object of this invention is to provide a hydraulic circuit construction for a working vehicle operable as a backhoe and also as a dozer which circuit is adapted for the two types of operations described above by a simple improvement in the valve arrangement of the extremely compact multiplex valve system employed therein. The circuit construction according to this invention is characterized in that the dozer valve, the first motor valve and the arm confluence valve are connected in series with one another to the first pump with the arm confluence valve being positioned downstream from the dozer and the first motor valves and that a change-over valve for interrupting supply of pressure fluid to the arm confluence valve is provided downstream from the dozer and the first motor valves and upstream from the confluence valve in multiplex valve arrangement in combination with the dozer, first motor and arm confluence valves.

The series connection of the first motor control valve and the dozer control valve permits the pressure fluid from the first pump to wholly flow into the first motor even when operating both of the dozer system and running systems, and accordingly there does not occur such a problem that the revolution speed of the first motor becomes lower than that of the second motor which results in an oblique running of the vehicle.

Furthermore, the change-over valve, when operated to interrupt the arm confluence circuit, enables the vehicle to perform a successful running out operation from a marshy ground by an arm operation without the first motor being urged to stop by the work load on the arm.

Thus the improvement according to this invention, in which the change-over valve is merely incorporated into the further multiplex valve assembly, assures the advantages of the multiplex valve assembly and gives such a greatly improved workability to the vehicle as described above in detail.

Another object of this invention is to impart improved operability to the vehicle.

DESCRIPTION OF THE PREFERRED EMBODIMENT

An embodiment of this invention will be described below in detail with reference to the accompanying drawings.

Figure 1:
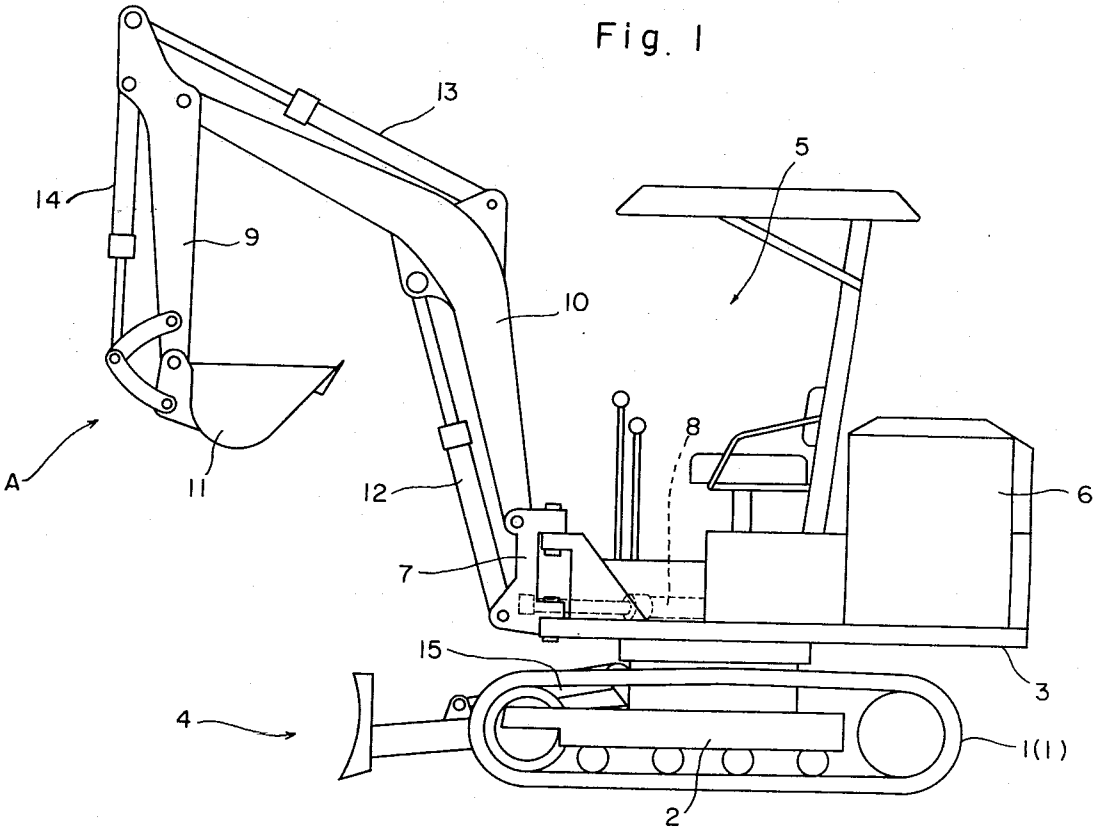
FIG. 1 is an overall side elevation showing a working vehicle operable as a backhoe and also as a dozer.

FIG. 1 shows a working vehicle which comprises a frame 2 equipped with right and left crawler running systems 1,1, a swivel platform 3 mounted on the frame 2 and provided with a backhoe system A, a driver's cab 5 and an engine assembly 6, and a dozer system 4 attached to the frame 2.

The backhoe system A comprises a bracket 7 pivoted to a forward end of the platform 3 oscillatably about a vertical axis by means of a bracket hydraulic cylinder 8, a boom 10 pivoted to a forward end of the bracket 7 oscillatably about a horizontal axis by means of a boom hydraulic cylinder 12, an arm 9 pivoted to a forward end of the boom 10 oscillatably about a horizontal axis by means of an arm hydraulic cylinder 13, and a bucket 11 pivoted to a forward end of the arm 9 oscillatably about a horizontal axis by means of a bucket hydraulic cylinder 14.

The dozer system 4 is adapted to be oscillated about a horizontal axis by means of a dozer hydraulic cylinder 15.

Figure 2:
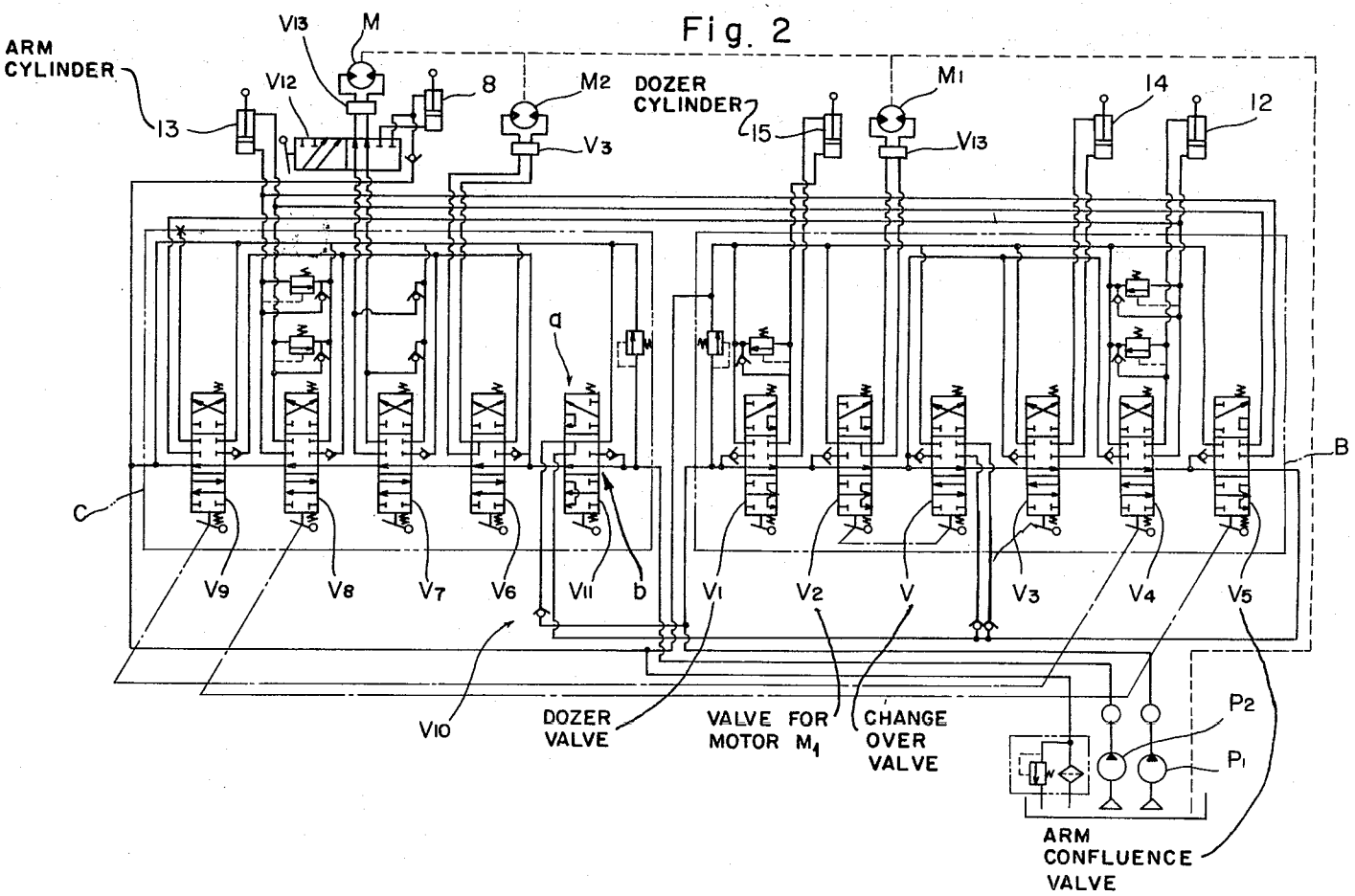
FIG. 2 is a diagram showing a hydraulic circuit construction.

FIG. 2 shows a hydraulic system consisting essentially of first and second hydraulic pumps $P_1$, $P_2$ of a fixed capacity type for operating first and second hydraulic motors $M_1$, $M_2$ for the right and left running systems 1,1, a platform hydraulic motor M for driving the swivel platform 3, the bracket, boom, arm and bucket hydraulic cylinders 8, 12, 13 and 14 for the backhoe system A, and the dozer hydraulic cylinder 15.

The first pump $P_1$ is connected to a first valve assembly B of a multiplex valve type, in which control valves $V_1$, $V_2$ of a series section type for the dozer cylinder 15 and the first motor $M_1$, control valves $V_3$, $V_4$ of a parallel section type for the boom and bucket cylinder 12, 14, an arm confluence control valve 15 of a series section type for the arm cylinder 13, and a change-over valve V for interrupting the supply of pressure fluid to the arm confluence valve $V_5$, with the change-over valve V positioned downstream from the dozer and first motor valves $V_1$, $V_2$ and upstream from the arm confluence valve $V_5$, are connected in series with one another to the first pump $P_1$.

The arm confluence valve $V_5$ enables the operation of the arm 10 by supplying confluent pressure fluid from the both pumps $P_1$, $P_2$ to the arm cylinder 13.

The change-over valve V is operatively connected to the first motor control valve $V_2$ by any of various means such as hydraulic coupling means, electric means, and link or like mechanical means, and adapted to automatically interrupt the supply of pressure fluid to the arm confluence control valve $V_5$ when the first motor valve $V_2$ is operated to supply pressure fluid to the first motor $M_1$.

Thus, by automatically stopping the pressure fluid flow from the first pump $P_1$ to the arm cylinder 12 during an arm operation while the vehicle is running, the vehicle operation is controllable so as to enable the vehicle, for example, to move out from a marshy ground.

Moreover, the vehicle can perform a bulldozing operation during travel while being prevented from running obliquely.

On the other hand, the second pump $P_2$ is connected to a second valve assembly C of a multiplex valve type, in which control valves $V_6$, $V_7$, $V_8$ and a boom confluence valve $V_9$ of a parallel section type for the second running motor $M_2$, the swivel motor M, the arm cylinder 13 and the boom cylinder 12 are connected in parallel with one another to the second pump $P_2$, and further a supply switching valve $V_{11}$ is interposed between the second pump $P_2$ and the second motor valve $V_6$, the supply switching valve $V_{11}$ comprising a series section a for combining the pressure fluid flows from the both pumps $P_1$, $P_2$ and feeding the combined fluid preferentially to the first motor $M_1$ through a one-way valve $V_{10}$ and subsequently to the second motor $M_2$, and a section b for supplying the pressure fluid from the first and second pumps $P_1$, $P_2$ to the first and second motors $M_1$, $M_2$ individually.

Thus, the change-over of the supply switching valve $V_{11}$ affords two-step running speed control, namely a low running speed provided by the supply of pressure fluid from the pumps $P_1$, $P_2$ to the motors $M_1$, $M_2$ respectively and a high running speed provided by the supply of the combined pressure fluid from the pumps $P_1$, $P_2$ to the motors $M_1$, $M_2$ in series. The boom confluence valve $V_9$ enables the operation of the boom 9 effected by the confluent pressure fluid supply from the pumps $P_1$, $P_2$.

The arm valve $V_8$ and the arm confluence valve $V_5$, as well as the boom valve $V_4$ and the boom confluence valve $V_9$, are operatively connected with each other.

What I claim is:

1. A hydraulic circuit construction for a working vehicle equipped with a backhoe means comprising a dozer means and right and left running means, a first hydraulic motor for one of the running means and a dozer hydraulic cylinder for the dozer means being coupled to be operated by a first hydraulic pump, a second hydraulic motor for the other running means and an arm hydraulic cylinder for an arm of a backhoe means are coupled to be operated by a second hydraulic pump, the arm cylinder being coupled to receive pressure fluid from the first and second pumps at the same time, a second multiplex valve assembly including a second motor control valve for the second motor and an arm control valve for the arm cylinder being connected in parallel with each other to the second pump, a first multiplex valve assembly including a dozer control valve for the dozer cylinder, a first motor control valve for the first motor and an arm confluence control valve for supplying pressure fluid from the first pump to the arm cylinder, wherein said dozer valve, said first motor valve and said arm confluence valve are connected in series with one another to the first pump with the arm confluence valve being positioned downstream from the dozer and the first motor valves and a change-over valve for interrupting supply of pressure fluid to the arm confluence valve is provided downstream from the dozer and first motor valves and upstream from the confluence valve in multiplex valve arrangement in combination with the dozer, first motor and arm confluence valves.

2. A hydraulic circuit construction as defined in claim 1 wherein said change-over valve is operatively connected to the first motor control valve and coupled to automatically interrupt the supply of pressure fluid to the arm confluence control valve when the first motor valve is operated to supply pressure fluid to the first motor.

* * * * *